US008862031B2

(12) United States Patent
Hashimoto

(10) Patent No.: US 8,862,031 B2
(45) Date of Patent: Oct. 14, 2014

(54) IMAGE FORMING APPARATUS

(75) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 143 days.

(21) Appl. No.: 13/432,061

(22) Filed: Mar. 28, 2012

(65) Prior Publication Data

US 2012/0251184 A1 Oct. 4, 2012

(30) Foreign Application Priority Data

Mar. 31, 2011 (JP) ..... 2011-078987

(51) Int. Cl.
*G03G 21/18* (2006.01)
*G03G 15/08* (2006.01)
*G03G 15/01* (2006.01)

(52) U.S. Cl.
CPC ..... *G03G 15/0121* (2013.01); *G03G 21/1857* (2013.01); *G03G 15/0896* (2013.01)
USPC ..... 399/228

(58) Field of Classification Search
CPC ..... G03G 15/0896; G03G 21/1857; G03G 2221/1657
USPC ..... 399/167, 252
See application file for complete search history.

(56) References Cited

U.S. PATENT DOCUMENTS 7,108,368 B2 9/2006 Saito et al.
7,526,232 B2 4/2009 Kamimura et al.
7,680,436 B2 3/2010 Hayakawa
7,706,723 B2 4/2010 Ishida et al.
7,826,773 B2 * 11/2010 Kawamura ..... 399/228
8,190,059 B2 5/2012 Hayakawa
2003/0138275 A1 7/2003 Yabuki et al.
2007/0053719 A1 3/2007 Kamimura et al.
2007/0147890 A1 6/2007 Hayakawa
2007/0177899 A1 8/2007 Kawamura (Continued)

FOREIGN PATENT DOCUMENTS

JP 2001-117314 4/2001
JP 2003-149910 A 5/2003

(Continued)

OTHER PUBLICATIONS

Machine Translation of JP 2003-149910 A obtained on Dec. 5, 2013.*

(Continued)

*Primary Examiner* — Gregory H Curran
(74) *Attorney, Agent, or Firm* — Banner & Witcoff, Ltd.

(57) ABSTRACT

An image forming apparatus includes a rotation driving source, a black developing unit, a color developing unit, a first gear, a second gear, a development drive transmission mechanism and a switching mechanism. The development drive transmission mechanism includes a first intermediate gear and a second intermediate gear. The switching mechanism includes a linear cam member configured to move linearly and to move the first intermediate gear and the second intermediate gear such that: in the first mode, the first gear engages the first intermediate gear and the second gear engages the second intermediate gear; in the second mode, the first gear engages the first intermediate gear and the second gear is disengaged from the second intermediate gear; in the third mode, the first gear is disengaged from the first intermediate gear.

16 Claims, 5 Drawing Sheets

(56) References Cited

U.S. PATENT DOCUMENTS

| | | | |
|---|---|---|---|
| 2008/0089713 | A1 | 4/2008 | Ishida et al. |
| 2009/0252530 | A1 | 10/2009 | Nakashima |
| 2011/0091237 | A1 | 4/2011 | Suzuki |
| 2011/0200359 | A1 | 8/2011 | Hayakawa |

FOREIGN PATENT DOCUMENTS

| | | | |
|---|---|---|---|
| JP | 2007-072021 | | 3/2007 |
| JP | 2007-178482 | A | 7/2007 |
| JP | 2008-116902 | A | 5/2008 |
| JP | 2009-036919 | A | 2/2009 |
| JP | 2009-162903 | | 7/2009 |
| JP | 2009-288358 | | 12/2009 |
| JP | 2010-262062 | | 11/2010 |

OTHER PUBLICATIONS

Notice of Reasons for Rejection issued in related Japanese Patent Application No. 2011-078987 mailed Mar. 19, 2013.
Co-pending U.S. Appl. No. 13/432,043, filed Mar. 28, 2012.
Co-pending U.S. Appl. No. 13/432,073, filed Mar. 28, 2012.
Non-final Office Action issued in U.S. Appl. No. 13/432,043 mailed Jan. 15, 2014.
First Office Action issued in corresponding Chinese Patent Application No. 201210090346.6 mailed May 6, 2014.

* cited by examiner

IMAGE FORMING APPARATUS

CROSS REFERENCE TO RELATED APPLICATION

The present application claims priority from Japanese Patent Application No. 2011-078987, which was filed on Mar. 31, 2011, the disclosure of which is incorporated herein by reference in its entirety.

BACKGROUND

1. Technical Field

The present invention relates to an image forming apparatus such as a color printer.

2. Related Art

An image forming apparatus including photosensitive drums corresponding to yellow, magenta, cyan and black, and developing units corresponding to the photosensitive drums.

In a color image formation process, each developing unit is driven and a toner image is formed on each photosensitive drum. In a monochrome image formation process, a toner image is formed only on a black photosensitive drum.

In such an image forming apparatus, a gear train for transmitting driving force to the black developing unit and a gear train for transmitting driving force to the yellow, magenta, cyan and black developing units are separately provided, and a rocking gear is provided between two gear trains. Driving force of the motor, which is rotatable in a forward direction and a reverse direction, is input in the rocking gear.

In this configuration, the motor is driven to rotate in one direction when forming a color image and in opposite direction when forming a monochrome image. Thus, it is difficult to use a motor as a driving source of other members of the color printer.

SUMMARY

A need has arisen to provide an image forming apparatus capable of transmitting rotation driving force from a rotation driving source selectively to all developing rollers or to only a black developing roller, and capable of using a rotation driving source as a driving source of other members.

An image forming apparatus includes a rotation driving source, a black developing unit, a color developing unit, a first gear, a second gear, a development drive transmission mechanism and a switching mechanism. The black developing unit includes a black developing roller configured to carry a black developing agent. The color developing unit includes a color developing roller configured to carry a color developing agent. The first gear is configured to drive the black developing roller to rotate. The second gear is configured to drive the color developing roller to rotate. The development drive transmission mechanism is configured to transmit rotation driving force of a predetermined direction from the rotation driving source to the first gear and to the second gear. The switching mechanism is configured to switch modes among a first mode in which the rotation driving force is transmitted to the first gear and to the second gear, a second mode in which the rotation driving force is transmitted to the first gear but not transmitted to the second gear, and a third mode in which the rotation driving force is not transmitted to neither the first gear nor to the second gear. The development drive transmission mechanism includes a first intermediate gear and a second intermediate gear. The first intermediate gear is capable of engaging with and disengaging from the first gear. The rotation driving force is transmitted to the first intermediate gear. The second intermediate gear is capable of engaging with and disengaging from the second gear. The rotation driving force is transmitted via the first intermediate gear. The switching mechanism includes a linear cam member configured to move linearly and to move the first intermediate gear and the second intermediate gear such that: in the first mode, the first gear engages the first intermediate gear and the second gear engages the second intermediate gear; in the second mode, the first gear engages the first intermediate gear and the second gear is disengaged from the second intermediate gear; in the third mode, the first gear is disengaged from the first intermediate gear.

DESCRIPTION OF THE PREFERRED EMBODIMENTS

An embodiment of the present invention will be described in detail with reference to the drawings.

1. Configuration of Color Printer

Figure 1:
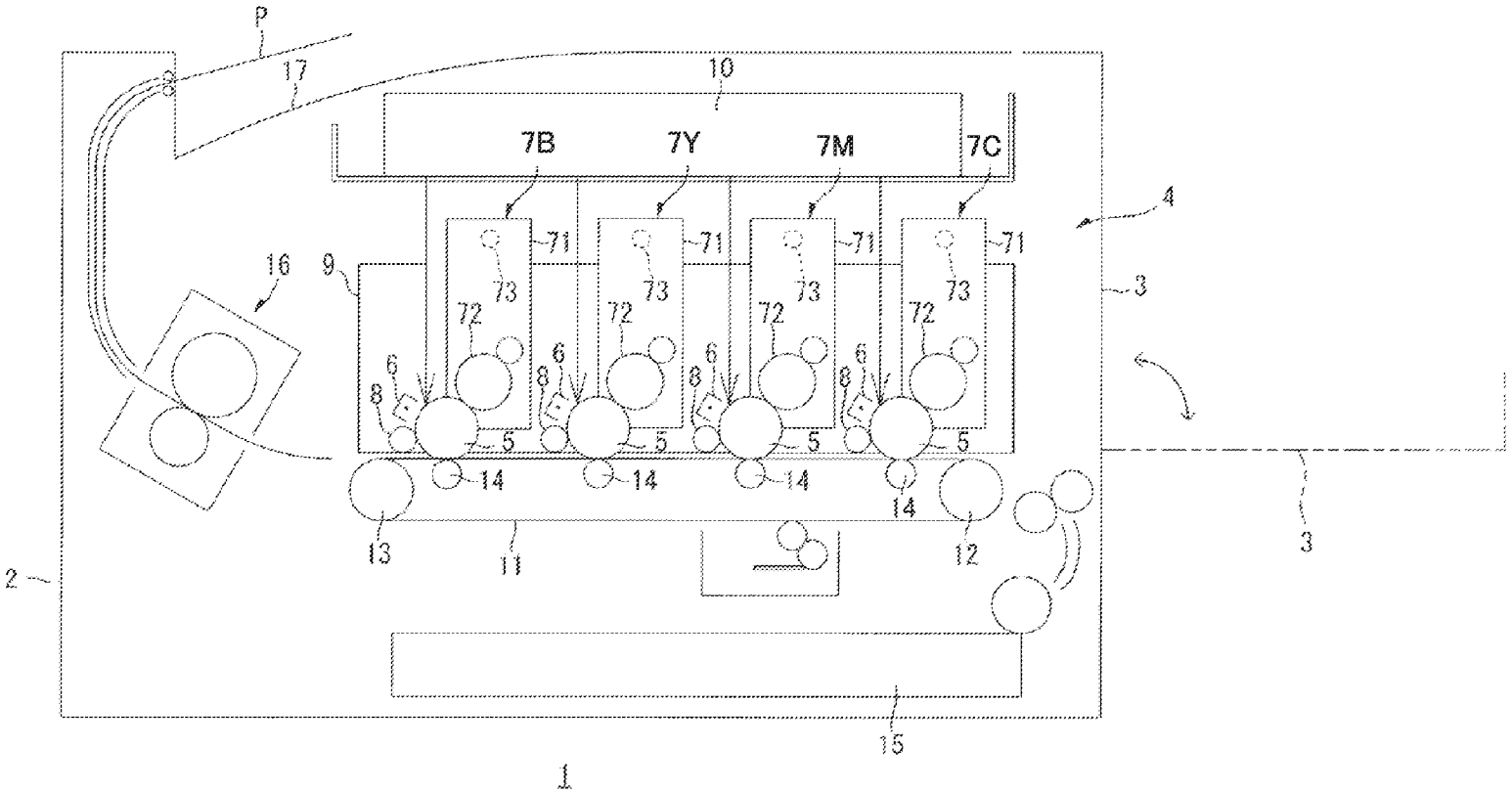
FIG. 1 illustrates, in a schematic sectional view, a color printer as an example of image forming apparatus of the present invention.

A color printer 1 (an example of an image forming apparatus) is provided with a main body casing 2 as illustrated in FIG. 1. A front cover 3 is provided in the front of the main body casing 2. An opening 4 is opened and closed by the action of the front cover 3.

The "front" of the color printer 1 is defined as the front side along the front-rear direction. The direction perpendicular to a plane on which the color printer 1 is placed is the "up-down direction." The "left" and "right" of the color printer 1 is defined on the basis of the front side of the color printer 1 placed on the plane.

Four photoconductor drums 5 are provided inside the main body casing 2. Each photoconductor drum 5 is circumferentially rotatable about an axis extending in the left-right direction. The four photoconductor drums 5 corresponding to black, yellow, magenta and cyan are arranged in parallel at regular intervals from the rear side in the front-rear direction in this order.

A charging unit 6, a developing unit 7B, 7Y, 7M, 7C and a collection member 8 are provided near each photoconductor drum 5. The charging unit 6 is situated at the upper rear of the photoconductor drum 5. The developing unit 7B, 7Y, 7M, 7C is situated at the upper front of the photoconductor drum 5. The collection member 8 is situated at the rear of the photoconductor drum 5.

Each developing unit 7B, 7Y, 7M, 7C is provided with a development housing 71 which receives toner (an example of a developing agent), and a developing roller 72 supported by the development housing 71. An opening elongated in the left-right direction is formed at the bottom end of the development housing 71. The developing roller 72 is provided at the bottom end of the development housing 71 to be rotatable about an axis extending in the left-right direction. A peripheral surface of the developing roller 72 is partially exposed through the opening of the bottom end of the development housing 71 and is in contact with a surface (i.e., a peripheral surface) of the photoconductor drum 5. A cylindrical presser boss 73 protrudes to the left and right from each upper end of left and right side surfaces of the development housing 71.

The photoconductor drums 5 of yellow, magenta and cyan are collectively referred to as "color photoconductor drums 5." The black photoconductor drum 5 is referred to as a "black photoconductor drum 5" when it is necessary to distinguish itself from the color photoconductor drums 5. The developing units 7B, 7Y, 7M, 7C provided for the color photoconductor drums 5 are referred to as "color developing units 7Y, 7M, 7C" (an example of a second developing unit) and the developing unit 7B provided for the black photoconductor drum 5 is referred to as a "black developing unit 7B" (an example of a first developing unit).

An exposure unit 10 which emits four laser beams of the four colors is provided at the topmost position of the main body casing 2.

In the image formation process, the photoconductor drums 5 are driven to rotate clockwise when seen from the left. As the photoconductor drum 5 is rotated, the surface of the photoconductor drum 5 is uniformly charged by the charging unit 6 and then is exposed selectively by the laser beams emitted from the exposure unit 10. The exposure selectively removes electric charge from the surface of the photoconductor drum 5 and, thereby, an electrostatic latent image is formed on the surface of the photoconductor drum 5. The electrostatic latent image is developed to be a toner image by the toner supplied from the developing roller 72 of the developing unit 7B, 7Y, 7M, 7C.

A paper sheet conveyor belt 11 is provided slightly below the center in the up-down direction of the main body casing 2. The paper sheet conveyor belt 11 is an endless belt running between rollers 12 and 13. The rollers 12 and 13 are situated at the same position in the up-down direction and are spaced from each other in the front-rear direction. The paper sheet conveyor belt 11 therefore has a planar portion extending in the front-rear and left-right directions between upper ends of the rollers 12 and 13. The planar portion is in contact with the four photoconductor drums 5.

A transfer roller 14 is provided to face each of the photoconductor drums 5 across the planar portion of the paper sheet conveyor belt 11. An exemplary transfer belt is constituted by the paper sheet conveyor belt 11 and the four transfer rollers 14.

A paper cassette 15 which receives a paper sheet P, which is an exemplary paper sheet, is provided at the bottom of the main body casing 2. The paper sheet P received in the paper cassette 15 is sent to the planar portion of the paper sheet conveyor belt 11 by various rollers. The paper sheet P is conveyed rearward on the paper sheet conveyor belt 11 through between the paper sheet conveyor belt 11 and the photoconductor drums 5.

In the image formation process, the paper sheet conveyor belt 11 is run counterclockwise when seen from the left. Transfer bias is applied to the transfer roller 14. In a process of forming a monochrome image on the paper sheet P, the toner image is formed on the surface of the black photoconductor drum 5. The toner image is transferred to the paper sheet P, while being conveyed on the paper sheet conveyor belt 11, by the effect of the transfer bias. Therefore, the monochrome image formed by a black toner image is formed on the paper sheet P. In a process of forming a color image on the paper sheet P, toner images are formed on the surfaces of at least two photoconductor drums 5. The toner images are transferred to the paper sheet P in a superimposed manner by the effect of the transfer bias while the paper sheet P is being conveyed on the paper sheet conveyor belt 11. Therefore, a color image formed by the superimposed color toner images is formed on the paper sheet P.

After the toner image on the photoconductor drum 5 is transferred to the paper sheet P, residual substances, such as toner, adhering to the surface of the photoconductor drum 5 are collected by the effect of the collection bias applied to the collection member 8 and are accumulated in the collection member 8.

A fixing unit 16 is provided at the rear of the paper sheet conveyor belt 11. The paper sheet P having the toner image transferred thereto is conveyed to the fixing unit 16. The fixing unit 16 fixes the toner image to the paper sheet P with heat and pressure. The paper sheet P having the toner image fixed thereto is output by various rollers to a paper output tray 17 situated on an upper surface of the main body casing 2.

2. Driving Mechanism

Figure 2:
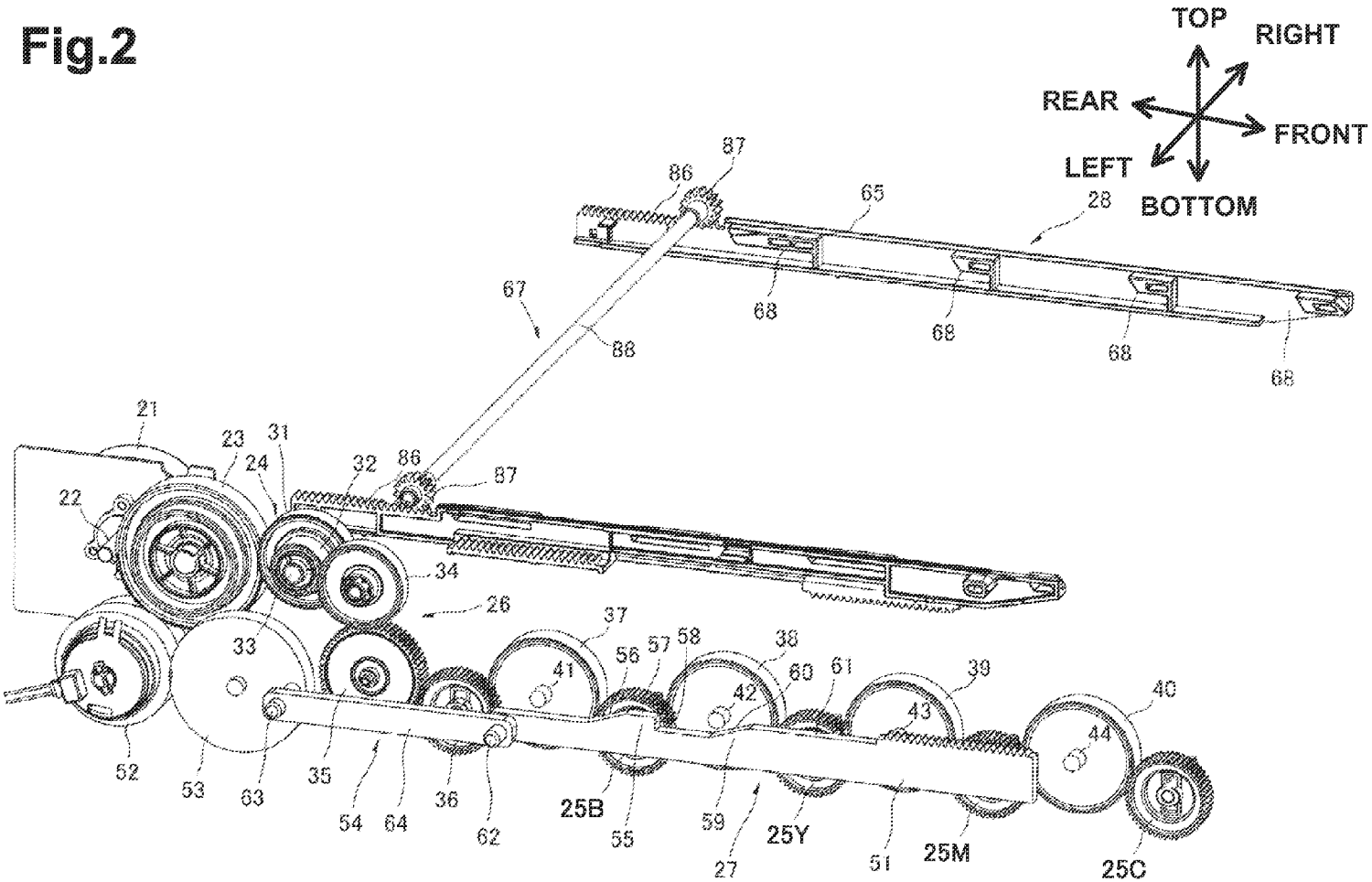
FIG. 2 illustrates, in a perspective view, a driving mechanism of the color printer.

A motor 21 (an example of a rotation driving source) is provided inside the main body casing 2 as illustrated in FIG. 2. Inside the main body casing 2, a motor gear 23, a two-step gear 24, four developing gears 25B, 25Y, 25M, 25C, a development drive transmission mechanism 26, a switching mechanism 27 and a pressing mechanism 28 are provided. The motor gear 23 engages a gear 22 provided on an output axis of the motor 21. The two-step gear 24 engages the motor gear 23. The development drive transmission mechanism 26 transmits the rotation of the two-step gear 24 (i.e., the rotation driving force from the motor 21) to the developing gear 25B, 25Y, 25M, 25C. The switching mechanism 27 switches the transmission/interception of the rotation driving force from the development drive transmission mechanism 26. The pressing mechanism 28 presses the developing unit 7B, 7Y, 7M, 7C in the direction in which the developing roller 72 is pressed against the photoconductor drum 5.

2-1. Two-Step Gear

The two-step gear 24 is integrally provided with a relatively large-diameter motor gear engagement section 31 and a relatively small-diameter development transmission gear engagement section 32. The motor gear engagement section 31 and the development transmission gear engagement section 32 are rotatable about a common rotational axis 33. The rotational axis 33 is supported by, for example, the main body casing 2. The two-step gear 24 is situated in the front of the motor gear 23. The motor gear engagement section 31 engages the motor gear 23.

A gear train (not illustrated) for transmitting the rotation of the motor gear engagement section 31 (i.e., the rotation driving force from the motor 21) to the photoconductor drum 5 is connected to the motor gear engagement section 31. The gear train and the motor gear engagement section 31 of the two-step gear 24 therefore form an example of a drum drive transmission mechanism.

2-2. Developing Gear

Each of the four developing gears 25B, 25Y, 25M, 25C is provided rotatably on a left surface of the development housing 71 of the developing unit 7B, 7Y, 7M, 7C. The developing gears 25B, 25Y, 25M, 25C are arranged at regular intervals along the front-rear direction. The rotation driving force transmitted to the developing gear 25B, 25Y, 25M, 25C drives each member (i.e., the member driven to rotate by the rotation driving force) provided in the developing unit 7B, 7Y, 7M, 7C, such as the developing roller 72, to rotate.

2-3. Developing Drive Transmission Mechanism

The development drive transmission mechanism 26 is provided with a first development transmission gear 34, a second development transmission gear 35, a third development transmission gear 36 (an example of a third gear), a first intermediate gear 37, a second intermediate gear 38, a third intermediate gear 39 and a fourth intermediate gear 40. The first development transmission gear 34, the second development transmission gear 35, the third development transmission gear 36, the first intermediate gear 37, the second intermediate gear 38, the third intermediate gear 39 and the fourth intermediate gear 40 are rotatably supported by, for example, the main body casing 2.

The first development transmission gear 34 is situated in front of the development transmission gear engagement section 32 and engages the development transmission gear engagement section 32.

The second development transmission gear 35 is situated below the first development transmission gear 34 and engages the first development transmission gear 34.

The third development transmission gear 36 is situated at a slightly lower front position of the second development transmission gear 35 and at the same height as those of the four developing gears 25B, 25Y, 25M, 25C. The third development transmission gear 36 engages the second development transmission gear 35.

A rotational shaft 41 of the first intermediate gear 37 is situated above a line segment which connects the center of rotation of the third development transmission gear 36 and the center of rotation of the developing gear 25B of the black developing unit 7B. The rotational shaft 41 is supported by the main body casing 2 to be rotatable and be movable in the up-down direction. The first intermediate gear 37 engages the third development transmission gear 36 and the developing gear 25B of the black developing unit 7B from above.

The developing gear 25B of the black developing unit 7B is an example of a first gear. Hereinafter, the developing gear 25B of the black developing unit 7B will be referred to as a "black developing gear 25B."

A rotational shaft 42 of the second intermediate gear 38 is situated above a line segment which connects the center of rotation of the black development gear 36 and the center of rotation of the developing gear 25Y of a yellow developing unit 7Y. The rotational shaft 42 is supported by the main body casing 2 to be rotatable and be movable in the up-down direction. The second intermediate gear 38 engages the black developing gear 25B and the developing gear 25Y of the yellow developing unit 7Y from above.

The developing gear 25Y of the yellow developing unit 7Y is an example of a second gear. Hereinafter, the developing gear 25Y of the yellow developing unit 7Y will be referred to as a "yellow developing gear 25Y."

A rotational shaft 43 of the third intermediate gear 39 is situated above a line segment which connects the center of rotation of the yellow development gear 25 and the center of rotation of the developing gear 25M of a magenta developing unit 7M. The rotational shaft 43 is supported by the main body casing 2 to be rotatable and be movable in the up-down direction. The third intermediate gear 39 engages the yellow developing gear 25Y and the developing gear 25M of the magenta developing unit 7M from above.

A rotational shaft 44 of the fourth intermediate gear 40 is situated above a line segment which connects the center of rotation of the development gear 25 of the magenta developing unit 7M and the center of rotation of the developing gear 25C of a cyan developing unit 7C. The rotational shaft 44 is supported by the main body casing 2 to be rotatable and be movable in the up-down direction. The fourth intermediate gear 40 engages the developing gear 25M of the magenta developing unit 7M and the developing gear 25C of the cyan developing unit 7C from above.

2-4. Switching Mechanism

The switching mechanism 27 is provided with a drive disengaging cam member 51, a rotating member 53 and a link mechanism 54. The drive disengaging cam member 51 is an example of a linear cam member and a moving cam member. The rotation driving force from the motor 21 is transmitted to the rotating member 53 via the motor gear 23 and an electromagnetic clutch 52. The link mechanism 54 converts the rotation of the rotating member 53 into a reciprocating linear movement of the drive disengaging cam member 51.

The drive disengaging cam member 51 is formed in an elongated thin plate shape having thickness in the left-right direction, and extends in the front-rear direction at the left side of the development drive transmission mechanism 26.

A cam 55 for the first intermediate gear protruding upward is provided at a position spaced forward from a rear end of the drive disengaging cam member 51. The cam 55 for the first intermediate gear is in a trapezoidal shape in a side view. In particular, the cam 55 for the first intermediate gear is provided with a slope 56 for the first intermediate gear, an upper surface 57 and a front surface 58. The slope 56 for the first intermediate gear is connected to and extends toward an upper front side of an upper surface of the rear end of the drive disengaging cam member 51. The upper surface 57 extends from a front edge of the slope 56 for the first intermediate gear in the front-rear direction (i.e., a direction parallel to the upper surface of the rear end of the drive disengaging cam member 51). The front surface 58 extends downward from the front edge of the upper surface 57 and is connected to the upper surface of the drive disengaging cam member 51. The inclination angle of the slope 56 for the first intermediate gear with respect to the upper surface of the drive disengaging cam member 51 is substantially the same as the inclination angle of the line segment which connects the center of rotation of the third development transmission gear 36 with respect to the upper surface of the drive disengaging cam member 51 and the center of rotation of the first intermediate gear 37.

A cam 59 for the second intermediate gear protruding upward is provided at a position spaced forward from the cam 55 for the first intermediate gear of the drive disengaging cam member 51. The cam 59 for the second intermediate gear is in a trapezoidal shape in a side view. In particular, the cam 59 for the second intermediate gear is provided with a slope 60 for the second intermediate gear and an upper surface 61. The slope 60 for the second intermediate gear is connected to and extends toward the upper front side of the upper surface of the drive disengaging cam member 51. The upper surface 61 extends from a front edge of the slope 60 for the second intermediate gear in the front-rear direction (i.e., the direction parallel to the upper surface of the drive disengaging cam member 51). The inclination angle of the slope 60 for the second intermediate gear with respect to the upper surface of the drive disengaging cam member 51 is substantially the same as the inclination angle of the line segment which connects the center of rotation of the black developing gear 25B with respect to the upper surface of the drive disengaging cam member 51 and the center of rotation of the second intermediate gear 38.

The rotating member 53 is in a disc shape of which central axis extends in the left-right direction and is rotatably supported by the main body casing 2.

The link mechanism 54 is provided with a front link shaft 62, a rear link shaft 63 and a link member 64. The front link shaft 62 protrudes to the left from the rear end of the drive disengaging cam member 51. The rear link shaft 63 protrudes to the left from the rotating member 53. The link member 64 is in a thin plate shape having thickness in the left-right direction. The front link shaft 62 is rotatably inserted in one end (i.e., the front end) of the link member 64 and the rear link shaft 63 is rotatably inserted in the other end (i.e., the rear end) of the link member 64.

2-5. Pressing Mechanism

The pressing mechanism 28 is provided with a pair of pressure linear members 65 (an example of a pressure linear member and a pressing member), a pressure drive transmission mechanism 66 (see FIG. 3) and a synchronization driving mechanism 67. The pressure drive transmission mechanism 66 transmits driving force to the left pressure linear member 65. The synchronization driving mechanism 67 lets the right pressure linear member 65 in synchronization with the left pressure linear member 65.

The pair of the pressure linear members 65 is situated above the development drive transmission mechanism 26 and the switching mechanism 27, spaced apart from each other in the left-right direction. Each pressure linear member 65 extends in the front-rear direction, formed in an elongated thin plate shape having thickness in the left-right direction, and is supported by a holder inside the main body casing 2 (not illustrated) to be movable in the front-rear direction.

Four pressure operation units 68 corresponding to the presser bosses 73 of the four developing units 7B, 7Y, 7M, 7C are provided on left-right direction inner surfaces of the pressure linear members 65. The four pressure operation units 68 are arranged in the front-rear direction such that the distance between the front edges of the two adjacent pressure operation units 68 in the front-rear direction is uniform. The pressure operation unit 68 corresponding to the presser boss 73 of the black developing unit 7B, i.e., the rearmost pressure operation unit 68, is longer in the front-rear direction than other three pressure operation units 68. As will be described below, such a difference in diameter allows all the developing rollers 72 to be pressed against the photoconductor drums 5, allows only the developing roller 72 of the black developing unit 7B (as an example of a black developing roller and a first developing roller) to be pressed against the photoconductor drum 5, or allows all the developing rollers 72 pressed against the photoconductor drums 5 to be separated from the photoconductor drums 5.

Figure 3:
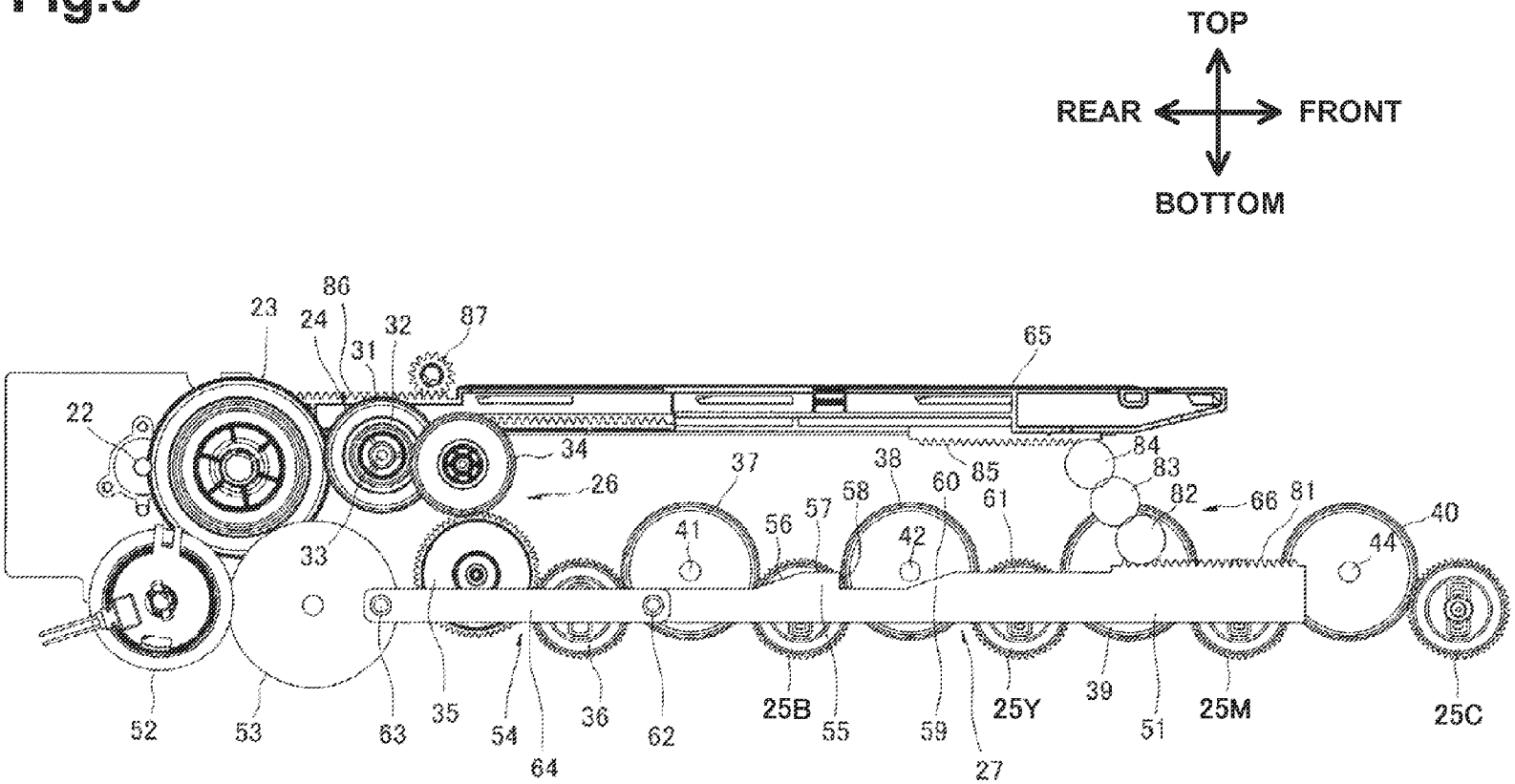
FIG. 3 illustrates, in a left side view, the driving mechanism in a color mode.

As illustrated in FIG. 3, the pressure drive transmission mechanism 66 is provided with an output rack gear 81, a first transmission gear 82, a second transmission gear 83, a third transmission gear 84 and an input rack gear 85. The output rack gear 81 is formed on an upper surface of a front end of the drive disengaging cam member 51. The first transmission gear 82 engages the output rack gear 81. The second transmission gear 83 engages the first transmission gear 82. The third transmission gear 84 engages the second transmission gear 83. The input rack gear 85 is formed on a lower surface of the front end of the left pressure linear member 65 and engages the third transmission gear 84. The first transmission gear 82, the second transmission gear 83 and the third transmission gear 84 are rotatably supported by the main body casing 2.

As illustrated in FIG. 2, the synchronization driving mechanism 67 is provided with rack gears 86, pinion gears 87 and a connecting shaft 87. Each of the rack gears 86 is formed on an upper surface of a rear end of each pressure linear member 65. Each of the pinion gears 87 engages each of the rack gears 86. The left and right pinion gears 87 are attached to the connecting shaft 88 so as not to be relatively rotated.

3. Operation

Operation modes of the color printer 1 includes a color mode in which a color image is formed on the paper sheet P, a monochrome mode in which a monochrome image is formed on the paper sheet P and a non-driving mode in which no developing rollers 72 of the developing units 7B, 7Y, 7M, 7C are driven.

In the color mode (an example of a first mode), the rear link shaft 63 is situated in the front of the center of rotation of the rotating member 53, and the drive disengaging cam member 51 and the link member 64 extend linearly in the front-rear direction as illustrated in FIG. 3. The cam 55 for the first intermediate gear and the cam 59 for the second intermediate gear are situated in the front of the rotational shaft 41 of the first intermediate gear 37 and the rotational shaft 42 of the second intermediate gear 38, respectively. The distance between the rotational shaft 41 of the first intermediate gear 37 and the slope 56 for the first intermediate gear of the cam 55 for the first intermediate gear is longer than the distance between the rotational shaft 42 of the second intermediate gear 38 and the slope 60 for the second intermediate gear of the cam 59 for the second intermediate gear.

The first intermediate gear 37 engages the third developing transfer gear 36 and the black developing gear 25B. The second intermediate gear 38 engages the black developing gear 25B and the yellow developing gear 25Y. The third intermediate gear 39 engages the yellow developing gear 25Y and the developing gear 25M of the magenta developing unit 7M. The fourth intermediate gear 40 engages the developing gear 25M of the magenta developing unit 7M and the developing gear 25C of the cyan developing unit 7C.

When the motor 21 is driven, the motor gear 23 is driven to rotate clockwise when seen from the left by the rotation driving force from the motor 21. With the rotation of the motor gear 23, the two-step gear 24 engaging the motor gear 23 is driven to rotate counterclockwise when seen from the left. The first developing transfer gear 34 engaging the development transmission gear engagement section 32 of the two-step gear 24 is driven to rotate clockwise when seen from the left, and the second developing transfer gear 35 engaging the first developing transfer gear 34 is driven to rotate counterclockwise when seen from the left. The third developing transfer gear 36 engaging the second developing transfer gear 35 is driven to rotate clockwise when seen from the left.

Since the first intermediate gear 37 engages the third developing transfer gear 36 and the black developing gear 25B, the first intermediate gear 37 is driven to rotate counterclockwise when seen from the left and the black developing gear 25B is driven to rotate clockwise when seen from the left accompanying the rotation of the third developing transfer gear 36.

Since the second intermediate gear 38 engages the black developing gear 25B and the yellow developing gear 25Y, the second intermediate gear 38 is driven to rotate counterclockwise when seen from the left and the yellow developing gear 25Y is driven to rotate clockwise when seen from the left accompanying the rotation of the black developing gear 25B.

Since the third intermediate gear 39 engages the yellow developing gear 25Y and the developing gear 25M of the magenta developing unit 7M, the third intermediate gear 39 is driven to rotate counterclockwise when seen from the left and the developing gear 25M of magenta developing unit 7M is driven to rotate clockwise when seen from the left accompanying the rotation of the yellow developing gear 25Y.

Since the fourth intermediate gear 40 engages the developing gear 25M of the magenta developing unit 7M and the developing gear 25C of the cyan developing unit 7C, the fourth intermediate gear 40 is driven to rotate counterclockwise when seen from the left and the developing gear 25C of the cyan developing unit 7C is driven to rotate clockwise when seen from the left accompanying the rotation of the developing gear 25M of the magenta developing unit 7M.

In this manner, in the color mode, the rotation driving force from the motor 21 is transmitted to the developing gears 25B, 25Y, 25M, 25C of all the developing units 7B, 7Y, 7M, 7C and all the developing gears 25B, 25Y, 25M, 25C are driven to rotate. Therefore, the developing rollers 72 of all the developing units 7B, 7Y, 7M, 7C are driven to rotate.

In the color mode, each of the pressure operation units 68 (see FIG. 2) of the pressure linear member 65 is pressed against each of the presser bosses 73 of the developing units 7B, 7Y, 7M, 7C from above. Therefore, all the developing rollers 72 are pressed against the photoconductor drums 5.

In the pressure drive transmission mechanism 66, the first transmission gear 82 engages a rear end of the output rack gear 81 and the third transfer gear 84 engages a front end of the input rack gear 85.

In the synchronization driving mechanism 67, the pinion gear 87 engages the front end of the input rack gear 85.

Figure 4:
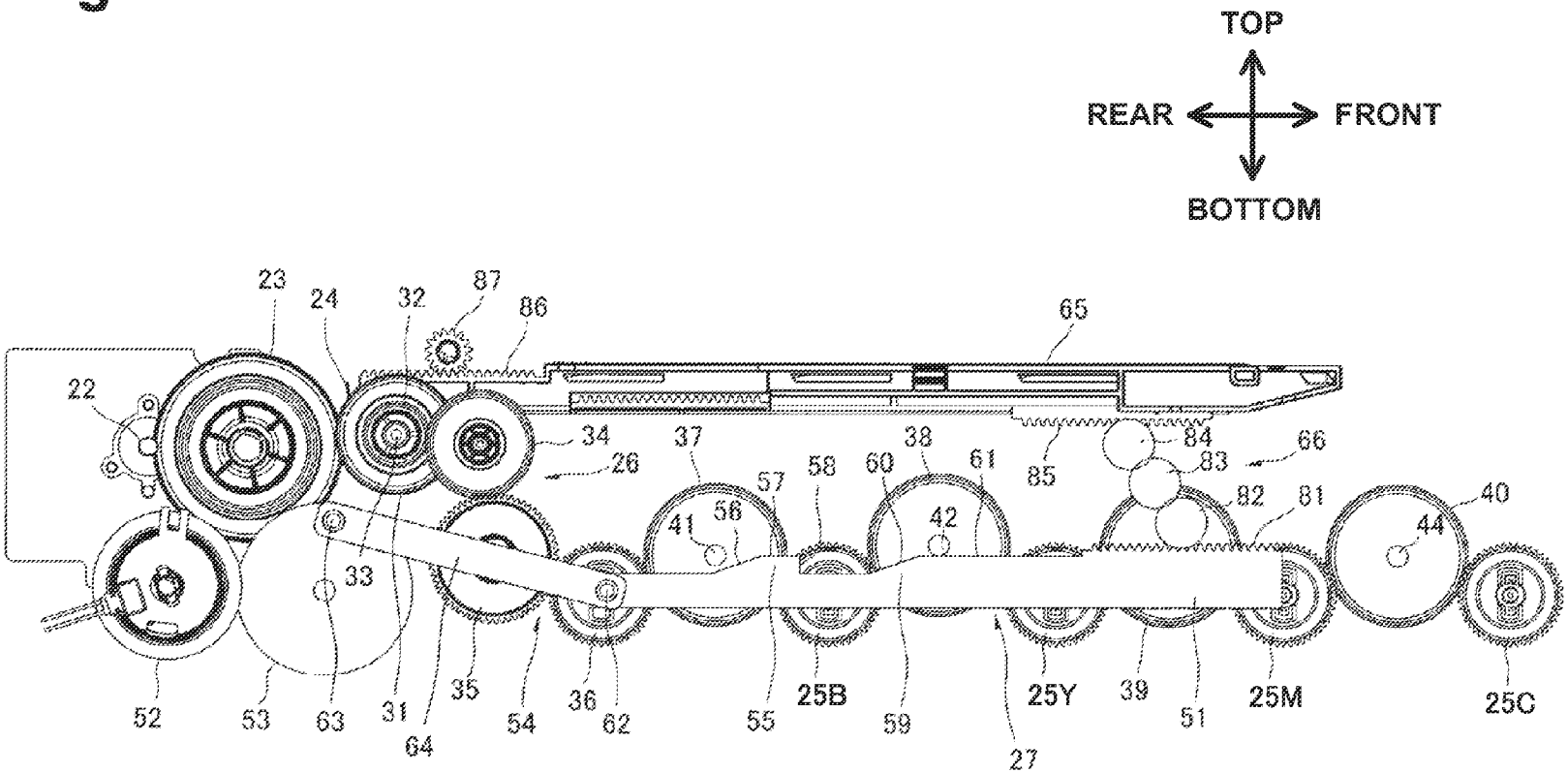
FIG. 4 illustrates, in a left side view, the driving mechanism in a monochrome mode.

When the operation mode is switched from the color mode to the monochrome mode (an example of a second mode), the electromagnetic clutch 52 enters a transmission state in which the rotation driving force from the motor 21 is transmitted to the rotating member 53 and the rotating member 53 is driven to rotate counterclockwise about 90 degrees when seen from the left. As illustrated in FIG. 4, the rear link shaft 63 is moved upward from a position in front of the center of rotation of the rotating member 53 and the rear end of the link member 64 is moved in a circular arc toward the upper rear direction accompanying the rotation of the rotating member 53. Accompanying the movement of the link member 64, the drive disengaging cam member 51 is moved rearward while still extending linearly in the front-rear direction.

In the movement of the drive disengaging cam member 51, the slope 60 for the second intermediate gear of the cam 59 for the second intermediate gear is brought into contact with the rotational shaft 42 of the second intermediate gear 38. Accompanying the movement of the drive disengaging cam member 51 after the slope 60 for the second intermediate gear of the cam 59 for the second intermediate gear is brought into contact with the rotational shaft 42 of the second intermediate gear 38, the rotational shaft 42 is moved on the slope 60 for the second intermediate gear toward the upper surface 61, and receives the force applied in the upper rear direction from the slope 60 for the second intermediate gear. The second intermediate gear 38 is therefore moved in the upper rear direction still in engagement with the black developing gear 25B and is separated from the yellow developing gear 25Y. Then, as illustrated in FIG. 4, the second intermediate gear 38 is disengaged from the yellow developing gear 25Y.

When the rotation of the rotating member 53 is stopped, the rotational shaft 42 is situated on the upper surface 61 of the cam 59 for the second intermediate gear and, thereafter, a state in which the second intermediate gear 38 is disengaged from the yellow developing gear 25Y is continued.

The first transmission gear 82 is rotated clockwise when seen from the left accompanying the rearward movement of the drive disengaging cam member 51. The second transmission gear 83 is rotated counterclockwise when seen from the left and the third transfer gear 84 is rotated clockwise when seen from the left accompanying the rotation of the first transmission gear 82. The pressure linear members 65 are moved forward and the pressure operation units 68 are separated from the presser bosses 73 of the color developing units 7Y, 7M, 7C accompanying the rotation of the third transfer gear 84. Then, the developing rollers 72 of the color developing units 7Y, 7M, 7C pressed against the color photoconductor drums 5 are separated from the color photoconductor drums 5. The presser boss 73 of the black developing unit 7B continues to be pressed by the pressure operation unit 68 from above and the presses black developing roller 72 is pressed against the black photoconductor drum 5.

In the monochrome mode, the motor 21 is driven in a state in which the second intermediate gear 38 is disengaged from the yellow developing gear 25Y. The rotation driving force from the motor 21 is transmitted to the black developing gear 25B, in the same manner as in the color mode, via the motor gear 23, the two-step gear 24, the first developing transfer gear 34, the second developing transfer gear 35, the third developing transfer gear 36 and the first intermediate gear 37. Since the second intermediate gear 38 engages the black developing gear 25B, the second intermediate gear 38 is rotated counterclockwise when seen from the left. Since the second intermediate gear 38 is disengaged from the yellow developing gear 25Y, however, the rotation of the second intermediate gear 38 is not transmitted to the yellow developing gear 25Y.

As described above, the black developing gear 25B is driven to rotate whereas the developing gears 25Y, 25M, 25C of other developing units 7Y, 7M, 7C are not driven to rotate in the monochrome mode. Therefore, the black developing roller 72 is driven to rotate while the developing rollers 72 of yellow, magenta and cyan developing units 7Y, 7M, 7C are stopped.

Figure 5:
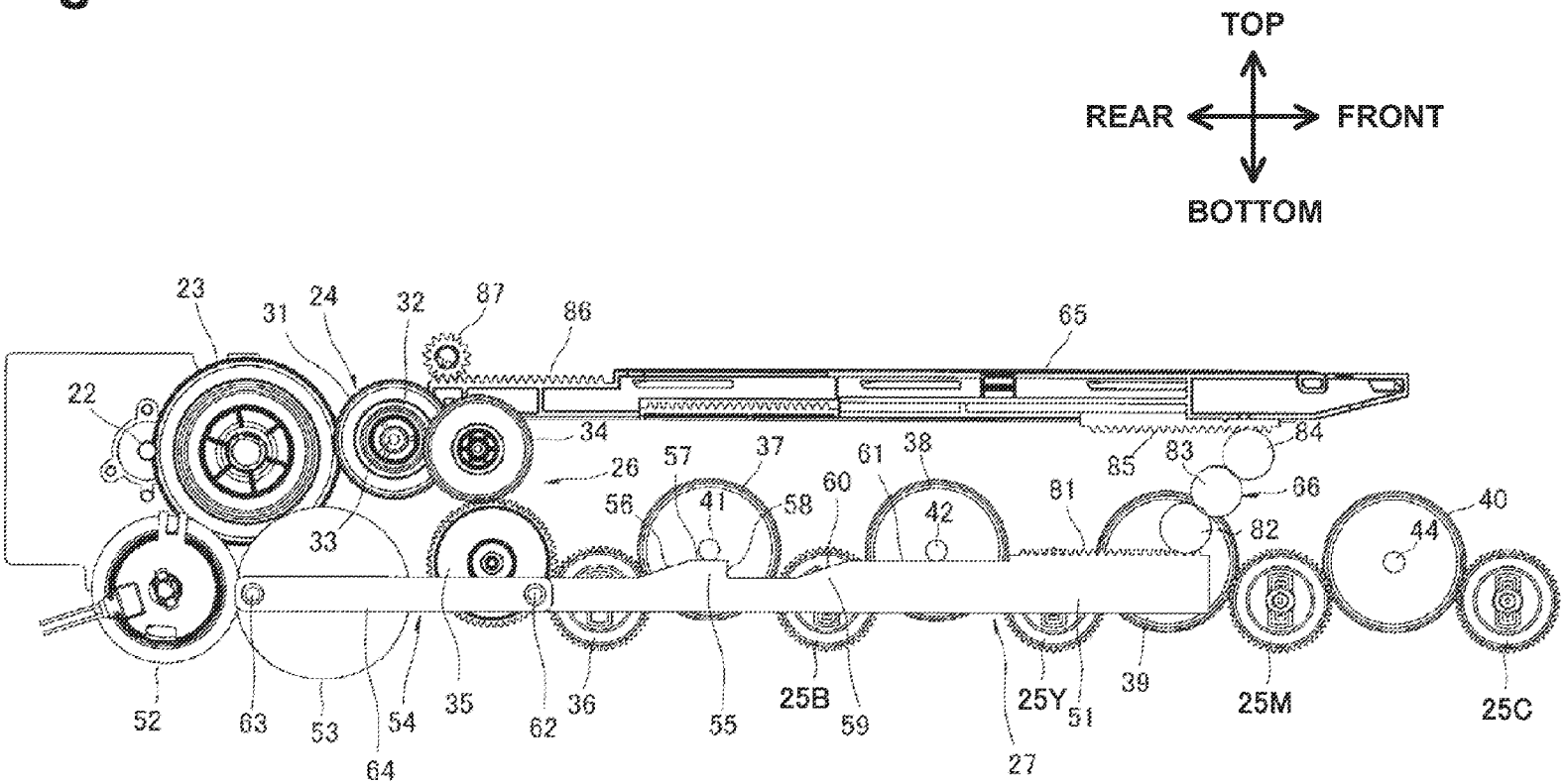
FIG. 5 illustrates, in a left side view, the driving mechanism in a non-driving mode.

When the operation mode is switched from the monochrome mode to the non-driving mode (an example of a third mode), the electromagnetic clutch 52 enters a transmission state in which the rotation driving force from the motor 21 is transmitted to the rotating member 53 and the rotating member 53 is driven to rotate counterclockwise about 90 degrees when seen from the left. As illustrated in FIG. 5, the rear link shaft 63 is moved rearward from an upper position of the center of rotation of the rotating member 53 and the rear end of the link member 64 is moved in a circular arc toward the lower rear direction accompanying the rotation of the rotating member 53. Accompanying the movement of the link member 64, the drive disengaging cam member 51 is moved rearward while still extending linearly in the front-rear direction.

In the movement of the drive disengaging cam member 51, the slope 56 for the first intermediate gear of the cam 55 for the first intermediate gear is brought into contact with the rotational shaft 41 of the first intermediate gear 37. Accompanying the movement of the drive disengaging cam member 51 after the slope 56 for the first intermediate gear of the cam 55 for the first intermediate gear is brought into contact with the rotational shaft 41 of the first intermediate gear 37, the rotational shaft 41 is moved on the slope 56 for the first intermediate gear toward the upper surface 57, and receives the force applied in the upper rear direction from the slope 56 for the first intermediate gear. The first intermediate gear 37 is therefore moved in the upper rear direction still in engagement with the third developing transfer gear 36 and is separated from the black developing gear 25B. Then, as illustrated in FIG. 5, the first intermediate gear 37 is disengaged from the black developing gear 25B.

When the rotation of the rotating member 53 is stopped, the rotational shaft 41 is situated on the upper surface 57 of the cam 55 for the first intermediate gear and, thereafter, a state in which the first intermediate gear 37 is disengaged from the black developing gear 25B is continued.

The first transmission gear 82 is rotated clockwise when seen from the left accompanying the rearward movement of the drive disengaging cam member 51. The second transmission gear 83 is rotated counterclockwise when seen from the left and the third transfer gear 84 is rotated clockwise when seen from the left accompanying the rotation of the first transmission gear 82. The pressure linear members 65 are moved forward and the pressure operation unit 68 is separated from the presser boss 73 of the black developing unit 7B accompanying the rotation of the third transfer gear 84. Then, the developing roller 72 of the black developing unit 7B pressed against the black photoconductor drum 5 is separated from the black photoconductor drum 5. Therefore, all the developing rollers 72 pressed against the photoconductor drums 5 are separated from the photoconductor drums 5.

Since the first intermediate gear 37 is disengaged from the black developing gear 25B in the non-driving mode, even if the motor 21 is driven to rotate, the rotation driving force from the motor 21 is not transmitted to the black developing gear 25B. Members other than the developing rollers 72 may thus be driven by the rotation driving force from the motor 21 while the rotation of all the developing rollers 72 is stopped.

When the operation mode is switched from the non-driving mode to the color mode, the electromagnetic clutch 52 enters the transmission state in which the rotation driving force from the motor 21 is transmitted to the rotating member 53 and the rotating member 53 is driven to rotate counterclockwise about 180 degrees when seen from the left. The rear link shaft 63 is moved forward from a position in rear of the center of rotation of the rotating member 53 and the rear end of the link member 64 is moved in a circular arc accompanying the rotation of the rotating member 53. Accompanying the movement of the link member 64, the drive disengaging cam member 51 is moved forward while still extending linearly in the front-rear direction.

In the movement of the drive disengaging cam member 51, the rotational shaft 41 of the first intermediate gear 37 is moved onto the slope 56 for the first intermediate gear from the upper surface 57 of the cam 55 for the first intermediate gear. Accompanying the movement of the drive disengaging cam member 51 thereafter, the rotational shaft 41 is moved downward along the slope 56 for the first intermediate gear. The first intermediate gear 37 is therefore moved in the lower front direction still in engagement with the third developing transfer gear 36 and engages the black developing gear 25B.

In the movement of the drive disengaging cam member 51, the rotational shaft 42 of the second intermediate gear 38 is moved onto the slope 60 for the second intermediate gear from the upper surface 61 of the cam 59 for the second intermediate gear. Accompanying the subsequent movement of the drive disengaging cam member 51, the rotational shaft 42 is moved downward along the slope 60 for the second intermediate gear. The second intermediate gear 38 is therefore moved in the lower front direction still in engagement with the black developing gear 25B and engages the yellow developing gear 25Y.

4. Operation and Effect 4-1. Operation and Effect 1

As described above, the black developing gear 25B which drives the black developing roller 72 to rotate and the yellow developing gear 25Y which drives the developing roller 72 of the yellow developing unit 7Y to rotate are provided. The development drive transmission mechanism 26 transmits, to the black developing gear 25B and the yellow developing gear 25Y, the rotation driving force of predetermined direction from the motor 21.

The developing roller 72 of the yellow developing unit 7Y is an example of a color developing roller and a second developing roller.

The color printer 1 has a color mode, a monochrome mode and a non-driving mode. The color mode, the monochrome mode and the non-driving mode are switched by the switching mechanism 27. The switching mechanism 27 is provided with the drive disengaging cam member 51. The development drive transmission mechanism 26 is provided with the first intermediate gear 37 and the second intermediate gear 38. The rotation driving force from the motor 21 is transmitted to the second intermediate gear 38 via the first intermediate gear 37. The linear movement of the drive disengaging cam member 51 causes the first intermediate gear 37 and the second intermediate gear 38 to be moved selectively. Then, engagement and disengagement of the first intermediate gear 37 and the second intermediate gear 38 with and from the black developing gear 25B and the yellow developing gear 25Y, respectively, are carried out.

In the color mode, the first intermediate gear 37 and the second intermediate gear 38 engage the black developing gear 25B and the yellow developing gear 25Y, respectively. Therefore, the rotation driving force is transmitted to the black developing gear 25B from the first intermediate gear 37 and the rotation driving force is transmitted to the yellow developing gear 25Y from the first intermediate gear 37 via the second intermediate gear 38. Thus, the black developing roller 72 and the developing roller 72 of the yellow developing unit 7Y are driven to rotate.

In the monochrome mode, the black developing gear 25B engages the first intermediate gear 37 and the yellow developing gear 25Y is disengaged from the second intermediate gear 38. The rotation driving force is therefore transmitted to the black developing gear 25B from first intermediate gear 37. Since the yellow developing gear 25Y does not engage the second intermediate gear 38, even if the rotation driving force is transmitted to the second intermediate gear 38 via the first intermediate gear 37, the rotation driving force is not transmitted to the yellow developing gear 25Y. Therefore, in the monochrome mode, the black developing roller 72 is driven to rotate while the developing rollers 72 of yellow, magenta and cyan developing units 7Y, 7M, 7C are not driven to rotate.

In the non-driving mode, the black developing gear 25B is disengaged from the first intermediate gear 37. The rotation driving force is therefore not transmitted to the black developing gear 25B from the first intermediate gear 37. The second intermediate gear 38 engages the black developing gear 25B and the rotation driving force is transmitted to the second intermediate gear 38 from the first intermediate gear 37 via the black developing gear 25B; therefore, unless the rotation driving force is transmitted to the black developing gear 25B, the rotation driving force is not transmitted to the second intermediate gear 38 and the rotation driving force is not transmitted to the yellow developing gear 25Y. No developing rollers 72 are thus driven to rotate in the non-driving mode.

As described above, the rotation driving force of the motor 21 may be transmitted selectively to all the developing rollers 72 or to the black developing roller 72. When it is not necessary to drive the black developing roller 72 to rotate, the black developing roller 72 may stay stopped. When it is not necessary to drive the developing rollers 72 of yellow, magenta and cyan developing units 7Y, 7M, 7C, the developing rollers 72 of yellow, magenta and cyan developing units 7Y, 7M, 7C may stay stopped. Therefore, damage to the toner due to unnecessary rotation of the developing rollers 72 and wear of the developing rollers 72 may be reduced.

In any of the color mode, the monochrome mode and the non-driving mode, the rotation driving force in a predetermined direction is output from the motor 21. Therefore, the motor 21 may be used also as a driving source of members other than the developing rollers 72.

4-2. Operation and Effect 2

The center of rotation of the second intermediate gear 38 is situated in the downstream of the line segment which connects the center of rotation of the black developing gear 25B and the center of rotation of the yellow developing gear 25Y along the direction in which the gear teeth of the yellow developing gear 25Y are moved (upper side). That is, the center of rotation of the second intermediate gear 38 is situated in the upstream of the line segment which connects the center of rotation of the black developing gear 25B and the center of rotation of the yellow developing gear 25Y along the direction in which the gear teeth of the black developing gear 25B are moved (lower side). Therefore, when the rotation driving force is transmitted to the second intermediate gear 38 from the black developing gear 25B, the second intermediate gear 38 (gear teeth) receives force from the black developing gear 25B in the direction in which the second intermediate gear 38 engages the yellow developing gear 25Y. When the rotation driving force is transmitted to the yellow developing gear 25Y from the second intermediate gear 38, the second intermediate gear 38 (gear teeth) receives force, as reaction force, from the yellow developing gear 25Y in the direction in which the second intermediate gear 38 engages the black developing gear 25B. Therefore, the second intermediate gear 38 engages securely the black developing gear 25B and the yellow developing gear 25Y; and thus the rotation driving force may be reliably transmitted to the yellow developing gear 25Y from the black developing gear 25B via the second intermediate gear 38.

4-3. Operation and Effect 3

The cam 59 for the second intermediate gear is formed in the drive disengaging cam member 51. Accompanying the linear movement of the drive disengaging cam member 51, the cam 59 for the second intermediate gear causes the second intermediate gear 38 to be moved and thereby the yellow developing gear 25Y is disengaged from the second intermediate gear 38.

4-4. Operation and Effect 4

More specifically, the cam 59 for the second intermediate gear is provided with the slope 60 for the second intermediate gear. Accompanying the movement of the drive disengaging cam member 51, the slope 60 for the second intermediate gear is brought into contact with the rotational shaft 42 of the second intermediate gear 38 and the second intermediate gear 38 receives force from the slope 60 for the second intermediate gear; thus, the second intermediate gear 38 is moved and the yellow developing gear 25Y is disengaged from the second intermediate gear 38.

The inclination angle of the slope 60 for the second intermediate gear with respect to the straight line along the direction in which the drive disengaging cam member 51 is moved is substantially the same as the inclination angle of the line segment which connects the center of rotation of the black developing gear 25B and the center of rotation of the second intermediate gear 38 with respect to the straight line. Therefore, the slope 60 for the second intermediate gear may apply force to the rotational shaft 42 of the second intermediate gear 38 in the direction perpendicular to the line segment which connects the center of rotation of the black developing gear 25B and the center of rotation of the second intermediate gear 38. As a result, the second intermediate gear 38 may be successfully moved about the center of rotation of the black developing gear 25B and the yellow developing gear 25Y may be successfully disengaged from the second intermediate gear 38.

4-5. Operation and Effect 5

In the non-driving mode, the yellow developing gear 25Y is disengaged from the second intermediate gear 38. It is therefore possible to reliably prevent the rotation driving force from being transmitted to the yellow developing gear 25Y. As a result, in the non-driving mode, the rotation of the developing rollers 72 of yellow, magenta and cyan developing units 7Y, 7M, 7C may be stopped reliably.

4-6. Operation and Effect 6

The development drive transmission mechanism 26 is provided with the third developing transfer gear 36 which engages the first intermediate gear 37. The rotation driving force may be transmitted to the first intermediate gear 37 from the third developing transfer gear 36.

4-7. Operation and Effect 7

The center of rotation of the first intermediate gear 37 is situated in the downstream of the line segment which connects the center of rotation of the black developing gear 25B and the center of rotation of the third developing transfer gear 36 along the direction in which the gear teeth of the black developing gear 25B are moved (upper side). That is, the center of rotation of the first intermediate gear 37 is situated in the upstream of the line segment which connects the center of rotation of the black developing gear 25B and the center of rotation of the third developing transfer gear 36 along the direction in which the gear teeth of the third developing transfer gear 36 are moved (lower side). Therefore, when the rotation driving force is transmitted to the first intermediate gear 37 from the third developing transfer gear 36, the first intermediate gear 37 (gear teeth) receives force from the third developing transfer gear 36 in the direction in which the first intermediate gear 37 engages the black developing gear 25B. When the rotation driving force is transmitted to the black developing gear 25B from the first intermediate gear 37, the first intermediate gear 37 (gear teeth) receives force, as reaction force, from the black developing gear 25B in the direction in which the first intermediate gear 37 engages the third developing transfer gear 36. Therefore, the first intermediate gear 37 engages securely the black developing gear 25B and the third developing transfer gear 36; and thus the rotation driving force may be reliably transmitted to the black developing gear 25B from the third developing transfer gear 36 via the second intermediate gear 38.

4-8. Operation and Effect 8

The cam 55 for the first intermediate gear is formed in the drive disengaging cam member 51. Accompanying the linear movement of the drive disengaging cam member 51, the cam 55 for the first intermediate gear causes the first intermediate gear 37 to be moved and thereby the black developing gear 25B is disengaged from the first intermediate gear 37.

4-9. Operation and Effect 9

More specifically, the cam 55 for the first intermediate gear is provided with the slope 56 for the first intermediate gear. Accompanying the movement of the drive disengaging cam member 51, the slope 56 for the first intermediate gear is brought into contact with the central shaft of the first intermediate gear 37 and the first intermediate gear 37 receives force from the slope 56 for the first intermediate gear; thus, the first intermediate gear 37 is moved and the black developing gear 25B is disengaged from the first intermediate gear 37.

The inclination angle of the slope 56 for the first intermediate gear with respect to the straight line along the direction in which the drive disengaging cam member 51 is moved is substantially the same as the inclination angle of the line segment which connects the center of rotation of the first intermediate gear 37 and the center of rotation of the third developing transfer gear 36 with respect to the straight line. Therefore, the slope 56 for the first intermediate gear may apply force to the center of rotation of the first intermediate gear 37 in the direction perpendicular to the line segment which connects the center of rotation of the third developing transfer gear 36 and the central shaft of the first intermediate gear 37. As a result, the first intermediate gear 37 may be successfully moved about the center of rotation of the third developing transfer gear 36 and the black developing gear 25B may be successfully disengaged from the first intermediate gear 37.

4-10. Operation and Effect 10

The switching mechanism 27 is provided with the rotating member 53 which is driven to rotate by the rotation driving force from the motor 21 and the link mechanism 54 which converts the rotation of the rotating member 53 into a reciprocating linear movement of the drive disengaging cam member 51. Therefore, the drive disengaging cam member 51 may reciprocate linearly by the rotation driving force from the motor 21. That is, the motor 21 may be used as a driving source of the drive disengaging cam member 51. It is therefore possible to reduce the number of driving sources that the color printer 1 is provided with.

4-11. Operation and Effect 11

The color printer 1 is provided with the black photoconductor drum 5 to which black toner is supplied from the black developing unit 7B, and the color photoconductor drums 5 to which toner is supplied from the color developing units 7Y, 7M, 7C. The color printer 1 is further provided with the pressing mechanism 28 which presses the black developing roller 72 and the developing rollers 72 of the color developing units 7Y, 7M, 7C against the black photoconductor drum 5 and the color photoconductor drums 5, respectively.

The pressing mechanism 28 causes the black developing roller 72 and the developing rollers 72 of the color developing units 7Y, 7M, 7C to be pressed against and separated from the black photoconductor drum 5 and the color photoconductor drums 5, respectively, by the rotation driving force from the motor 21. That is, the motor 21 is used as a driving source of the pressing mechanism 28. It is therefore possible to further reduce the number of driving sources that the color printer 1 is provided with.

4-12. Operation and Effect 12

The color printer 1 is provided with the drum drive transmission mechanisms (e.g., the motor gear engagement section 31 of the two-step gear 24) which transmits the rotation driving force from the motor 21 to the black photoconductor drum 5 and to the color photoconductor drums 5. The black photoconductor drum 5 and the color photoconductor drums 5 may be driven to rotate by the rotation driving force from the motor 21. That is, the motor 21 may be used as a driving source of the black photoconductor drum 5 and the color photoconductor drums 5. It is therefore possible to reduce the number of driving sources that the color printer 1 is provided with.

5. Modification

Although an embodiment of the present invention has been described, various design changes may be made to the configuration described above within the scope defined by the claims.

For example, the first intermediate gear 37 may engage or may be disengaged from the black developing gear 25B in the embodiment described above; but the first intermediate gear 37 may engage or may be disengaged from the black developing gear 25B and the third developing transfer gear 36.

The second intermediate gear 38 may engage or may be disengaged from the yellow developing gear 25Y in the embodiment described above; but the second intermediate gear 38 may engage or may be disengaged from the black developing gear 25B and the developing gear 25Y of the yellow developing unit 7Y.

The second intermediate gear 38 is disengaged from the yellow developing gear 25Y in the non-driving mode in the embodiment described above; but the second intermediate gear may engage the yellow developing gear 25Y.

The drive disengaging cam member 51 may move linearly in the embodiment described above; but the drive disengaging cam member 51 may not move linearly. For example, the drive disengaging cam member 51 and the link mechanism 54 may be integrally formed. In this case, the rotating member 53 rotates, and the drive disengaging cam member 51 and the link mechanism 54 move integrally at a tilt.

The four photoconductor drums corresponding to black, yellow, magenta and cyan are arranged from the rear side in the front-rear direction in this order in the embodiment described above; but the four photoconductor drums may not be arranged in this order.

What is claimed is:

1. An image forming apparatus comprising:

a rotation driving source;

a black developing unit comprising a black developing roller configured to carry a black developing agent;

a color developing unit comprising a color developing roller configured to carry a color developing agent;

a first gear configured to drive the black developing roller to rotate;

a second gear configured to drive the color developing roller to rotate;

a development drive transmission mechanism configured to transmit rotation driving force of a predetermined direction from the rotation driving source to the first gear and to the second gear; and a switching mechanism configured to switch modes between a first mode in which the rotation driving force is transmitted to the first gear and to the second gear, a second mode in which the rotation driving force is transmitted to the first gear but not transmitted to the second gear, and a third mode in which the rotation driving force is not transmitted to either the first gear or the second gear, wherein:

the development drive transmission mechanism comprises:

a first intermediate gear capable of engaging with and disengaging from the first gear, the rotation driving force being transmitted to the first intermediate gear, and a second intermediate gear capable of engaging with and disengaging from the second gear, the rotation driving force being transmitted via the first intermediate gear; and the switching mechanism comprises a linear cam member configured to move linearly and to move the first intermediate gear and the second intermediate gear such that:

in the first mode, the first gear engages the first intermediate gear and the second gear engages the second intermediate gear;

in the second mode, the first gear engages the first and second intermediate gears and the second gear is disengaged from the second intermediate gear; and in the third mode, the first gear is disengaged from the first intermediate gear.

2. The image forming apparatus according to claim 1, wherein the second intermediate gear is configured to contact the first gear in the second mode.

3. The image forming apparatus according to claim 2, wherein a center of rotation of the second intermediate gear is positioned at a downstream side of a line segment connecting a center of rotation of the first gear and a center of rotation of the second gear along a direction in which gear teeth of the second gear moves.

4. The image forming apparatus according to claim 2, wherein the linear cam member comprises a cam for the second intermediate gear, the cam configured to move the second intermediate gear and disengage the second gear from the second intermediate gear.

5. The image forming apparatus according to claim 4, wherein:

the cam for the second intermediate gear has a slope configured to, as the linear cam member moves, contact a rotational shaft of the second intermediate gear and move the second intermediate gear; and an inclination angle of the slope for the second intermediate gear with respect to a straight line extending along a direction in which the linear cam member moves is substantially the same as an inclination angle of a line segment connecting a center of rotation of the first gear and a center of rotation of the second intermediate gear with respect to the straight line.

6. The image forming apparatus according to claim 1, wherein the linear cam member is configured to disengage the second gear from the second intermediate gear in the third mode.

7. The image forming apparatus according to claim 1, wherein the development drive transmission mechanism further comprises a third gear configured to engage the first intermediate gear and transmit the rotation driving force to the first intermediate gear.

8. The image forming apparatus according to claim 7, wherein a center of rotation of the first intermediate gear is positioned at a downstream side of a line segment connecting a center of rotation of the first gear and a center of rotation of the third gear along a direction in which gear teeth of the first gear moves.

9. The image forming apparatus according to claim 7, wherein the linear cam member comprises a cam for the first intermediate gear, the cam configured to move the first intermediate gear and disengage the first gear from the first intermediate gear.

10. The image forming apparatus according to claim 1, wherein the switching mechanism comprises:

a rotating member configured to be rotated by the rotation driving force; and a link mechanism configured to convert rotation of the rotating member into a reciprocating linear movement of the linear cam member.

11. The image forming apparatus according to claim 1, further comprising:

a black photoconductor drum to which a black developing agent is supplied from the black developing roller;

a color photoconductor drum to which a color developing agent is supplied from the color developing roller; and a pressing mechanism configured to, based on the rotation driving force:

in the first mode, press the black developing roller and the color developing roller against the black photoconductor drum and the color photoconductor drum, respectively;

in the second mode, press the black developing roller against the black photoconductive drum and disengage the color developing roller from the color photoconductor drum; and in the third mode, disengage the black developing roller from the black photoconductor drum and disengage the color developing roller from the color photoconductor drum.

12. The image forming apparatus according to claim 1, further comprising:

a black photoconductor drum to which a black developing agent is supplied from the black developing roller;

a color photoconductor drum to which a color developing agent is supplied from the color developing roller; and a drum drive transmission mechanism configured to transmit the rotation driving force to the black photoconductor drum and to the color photoconductor drum.

13. The image forming apparatus according to claim 11, wherein:

the pressing mechanism comprises a pressing member and a pressure drive transmission mechanism; and the pressure drive transmission mechanism is configured to be driven by movement of the linear cam member and to transmit the rotation driving force to the pressing member by driving the pressing mechanism.

14. An image forming apparatus comprising:

a rotation driving source;

a first developing unit comprising a first developing roller configured to carry a first developing agent;

a second developing unit comprising a second developing roller configured to carry a second developing agent;

a first gear configured to drive the first developing roller to rotate;

a second gear configured to drive the second developing roller to rotate;

a development drive transmission mechanism configured to transmit rotation driving force of a predetermined direction from the rotation driving source to the first gear and to the second gear; and a switching mechanism configured to switch modes between a first mode in which the rotation driving force is transmitted to the first gear and to the second gear, a second mode in which the rotation driving force is transmitted to the first gear but not transmitted to the second gear, and a third mode in which the rotation driving force is not transmitted to either the first gear or to the second gear, wherein:

the development drive transmission mechanism comprises:

a first intermediate gear capable of engaging with and disengaging from the first gear, the rotation driving force being transmitted to the first intermediate gear, and a second intermediate gear capable of engaging with and disengaging from the second gear, the rotation driving force being transmitted via the first intermediate gear; and the switching mechanism comprises a moving cam member configured to move and to move the first intermediate gear and the second intermediate gear such that:

in the first mode, the first gear contacts the first intermediate gear and the second gear contacts the second intermediate gear;

in the second mode, the first gear contacts the first intermediate gear and the second gear is disengaged from the second intermediate gear; and in the third mode, the first gear is disengaged from the first intermediate gear.

15. The image forming apparatus according to claim 14, wherein movement of the switching mechanism includes linear movement.

16. An image forming apparatus comprising:

a rotation driving source;

a black developing unit comprising a black developing roller configured to carry a black developing agent;

a color developing unit comprising a color developing roller configured to carry a color developing agent;

a first gear configured to drive the black developing roller to rotate;

a second gear configured to drive the color developing roller to rotate;

a development drive transmission mechanism configured to transmit rotation driving force of a predetermined direction from the rotation driving source to the first gear and to the second gear; and a switching mechanism configured to switch modes between a first mode in which the rotation driving force is transmitted to the first gear and to the second gear, a second mode in which the rotation driving force is transmitted to the first gear but not transmitted to the second gear, and a third mode in which the rotation driving force is not transmitted to either the first gear or the second gear, wherein:

the development drive transmission mechanism comprises:

a first intermediate gear capable of engaging with and disengaging from the first gear, the rotation driving force being transmitted to the first intermediate gear, a second intermediate gear capable of engaging with and disengaging from the second gear, the rotation driving force being transmitted via the first intermediate gear, and a third gear configured to engage the first intermediate gear and transmit the rotation driving force to the first intermediate gear;

the switching mechanism comprises a linear cam member configured to move linearly and to move the first intermediate gear and the second intermediate gear such that:

in the first mode, the first gear engages the first intermediate gear and the second gear engages the second intermediate gear;

in the second mode, the first gear engages the first intermediate gear and the second gear is disengaged from the second intermediate gear; and in the third mode, the first gear is disengaged from the first intermediate gear;

the linear cam member comprises a cam for the first intermediate gear, the cam configured to move the first intermediate gear and disengage the first gear from the first intermediate gear;

the cam for the first intermediate gear has a slope configured to, as the linear cam member moves, contact a rotational shaft of the first intermediate gear and move the first intermediate gear; and an inclination angle of the slope for the first intermediate gear with respect to a straight line extending along a direction in which the linear cam member moves is substantially the same as an inclination angle of a line segment connecting a center of rotation of the first intermediate gear and a center of rotation of the third gear with respect to the straight line.

* * * * *